US006452568B1

(12) United States Patent
Zidek

(10) Patent No.: US 6,452,568 B1
(45) Date of Patent: Sep. 17, 2002

(54) DUAL CIRCULARLY POLARIZED BROADBAND ARRAY ANTENNA

(75) Inventor: Paul A. Zidek, Lafayette, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/851,470

(22) Filed: May 7, 2001

(51) Int. Cl.[7] ..... H01Q 1/36
(52) U.S. Cl. ..... 343/895; 343/700 MS
(58) Field of Search ..... 343/895, 700 MS, 343/846; H01Q 1/36, 1/38

(56) References Cited

U.S. PATENT DOCUMENTS

| | | | | |
|---|---|---|---|---|
| 2,953,781 A | | 9/1960 | Donnellan et al. | 343/100 |
| 2,977,594 A | | 3/1961 | Marston et al. | 343/756 |
| 3,039,099 A | | 6/1962 | Chait et al. | 343/851 |
| 3,045,237 A | | 7/1962 | Marston | 343/754 |
| 3,374,483 A | * | 3/1968 | Fenwick | 343/895 |
| 3,656,168 A | | 4/1972 | Stropki | 343/895 |
| 4,087,821 A | | 5/1978 | Phelan | 343/754 |
| 5,146,234 A | | 9/1992 | Lalezari | 343/895 |
| 5,223,849 A | * | 6/1993 | Kaswvich et al. | 343/895 |
| 5,936,594 A | | 8/1999 | Yu et al. | 343/895 |
| 5,990,849 A | | 11/1999 | Salvail et al. | 343/895 |
| 6,067,058 A | * | 5/2000 | Volman | 343/895 |

* cited by examiner

*Primary Examiner*—Hoanganh Le
(74) *Attorney, Agent, or Firm*—Sheridan Ross P.C.

(57) ABSTRACT

A dual circularly polarized broadband array antenna includes two arrays of spiral-like antenna elements. The arrays of spiral-like antenna elements are oppositely oriented and located on opposite sides of a substrate member. The spiral-like antenna elements have a loop portion with a free end, and a tail portion. The tail portion of adjacent antenna elements are connected to one another. The antenna elements have feed points, located at the free end, with the feed points of the first array being offset from the feed points of the second array. Each feed point is connected to a balun. The offset of the feed points is adjusted to achieve enhanced isolation between the signals from the two arrays. The antenna can have tuning elements adjacent to the substrate member.

18 Claims, 5 Drawing Sheets

DUAL CIRCULARLY POLARIZED BROADBAND ARRAY ANTENNA

FIELD OF THE INVENTION

The present invention is related to antennas, and more particularly to array antennas employing dual polarized antennas having oppositely oriented spiral like antenna elements.

BACKGROUND OF THE INVENTION

High gain antennas with circular polarization are useful for communication purposes as well as radar and other receiving and transmitting uses. Typically dual circular polarization for a single broadband antenna element is achieved by employing sinuous antenna elements or modulated multi-width spirals. In both cases, the elements are fed at nearly the same point in space thereby increasing the complexity of the feed. The sinuous antenna is planar, broadband and dual polarized from a single aperture. However, the sinuous antenna has several drawbacks, not the least of which is that it is difficult to construct. The sinuous antenna includes at least four separate antenna arms on its planar surface. The antenna arms radiate out in identical sinuous patterns symmetrically about a center point. The antenna arms cannot contact each other, and each antenna arm must be center fed independently of the others. Given the close proximity of the centers of the arms, the design does not lend itself to low cost manufacturing schemes. This is further complicated by the fact that the ability of such antennas to receive or transmit high frequency signals is determined by the accuracy of the antenna arms near the center of the antenna close to the feed point. Accordingly, as high accuracy is required of the centers of the separate antenna arms, and each antenna arm must be center fed, construction constraints necessarily either diminish the high end abilities of sinuous antennas and/or make construction of sinuous antennas more difficult and costly.

Further, sinuous antennas need additional circuitry, in the form of a hybrid circuit connected to the center feeds, to receive right-hand and left-hand circularly polarized signals. This additional hardware adds to the cost of the antenna, and requires additional manufacturing steps. Therefore, the sinuous antenna is complex and difficult to construct.

Another dual circular polarization antenna is disclosed in U.S. Pat. No. 5,416,234, which discloses an antenna having an upper set of spiral arms 10 and a lower set of spiral arms 12 which are oppositely oriented and stacked, as shown in FIG. 1A. This antenna allows for a dual polarized signal without the need for sinuous antenna arms and additional hybrid circuitry. While this allows less hardware, and thus eases the manufacture of the antenna as compared to a sinuous antenna, the elements are stacked directly above and beneath each other, and can be fed from the center of each element with feeds 14, as shown in FIG. 1B. This co-location of feed points makes manufacture of the antenna difficult.

Alternatively, the elements may be fed from ends of the spiral arms with feeds 16, as shown in FIG. 1C. While this configuration allows for more ease of manufacture as the feeds are not co-located, it does not allow for the elements to be conveniently arranged into an array, as the ends of the arms can not be connected to one another and the elements cannot be tightly packed within a lattice to support high frequency performance and still exhibit good low frequency performance. Also, the number of feed points for this arrangement would be increased, as each spiral arm in an element would need an individual feed point at the end of the arm. Further, the bandwidth is limited for end fed elements as compared to center fed elements.

Additionally, as the elements are stacked directly above and beneath one another, this can create coupling between the elements, thus degrading the signal from the elements. For a right handed circularly polarized signal and a left handed circularly polarized signal sent simultaneously, the location of these two elements may create coupling which can degrade the isolation between the two polarizations. Maximum isolation between the two polarizations is desirable. However, it must be accomplished without compromising dual circular polarization performance.

SUMMARY OF THE INVENTION

In accordance with the present invention, a dual array antenna is disclosed. The antenna has a first array comprising a first plurality of spiral-like antenna elements interconnected together on a first surface. The antenna has a second array comprising a second plurality of spiral-like antenna elements interconnected together on a second surface. Each of the elements has a feed point, with the feed points of the elements of the first array being offset from the feed points of the elements of the second array. In a preferred embodiment, the first and second surfaces are top and bottom surfaces of a substrate.

The feed points of the elements within the first array are separated by a lateral distance. The feed points of the elements of the second array are separated from the feed points of the elements of the first array by an offset lateral distance that is parallel to the lateral distance, and an axial distance that is perpendicular to the lateral distance. In one embodiment, the offset lateral distance is at least one-eighth of the lateral distance and preferably about one-half of the lateral distance. The feed points of the elements in each array lie in a plane, with the plane for the first array being parallel to the plane for the second array, and the elements in the first array are offset in at least an X direction from the feed points of the elements in the second array, and preferably offset in both the X direction and Y direction. The feed points are connected to baluns which are non-co-planer relative to the first plurality and second plurality of antenna elements. In one embodiment, the antenna also has one or more tuning members disposed outwardly of the substrate member.

The offset of the feed points of the first and second arrays of antenna elements is determined based on a number of factors. These factors include: impedance associated with the antenna, an operating frequency range associated with the antenna, a bandwidth associated with the antenna, and a gain associated with the antenna.

The antenna elements include a loop portion having a free end, and a tail portion. On one embodiment, the tail portions of adjacent antenna elements within the first or second array are joined together and are substantially straight where they are joined together.

Based on the foregoing summary, a number of advantages of the present invention are noted. A dual array is provided that can generate left hand circularly polarized and right hand circularly polarized signals. These signals are generated with reduced coupling between the two arrays, thus enhancing the isolation of the two polarizations. The antenna can also generate or receive high frequency signals. The configuration of the antenna allows for ease of manufacturing, thus reducing cost associated with the manufacture of the antenna.

Other features and advantages will be apparent from the following discussion, particularly when taken together with the accompanying drawings.

DETAILED DESCRIPTION

Figure 1A:
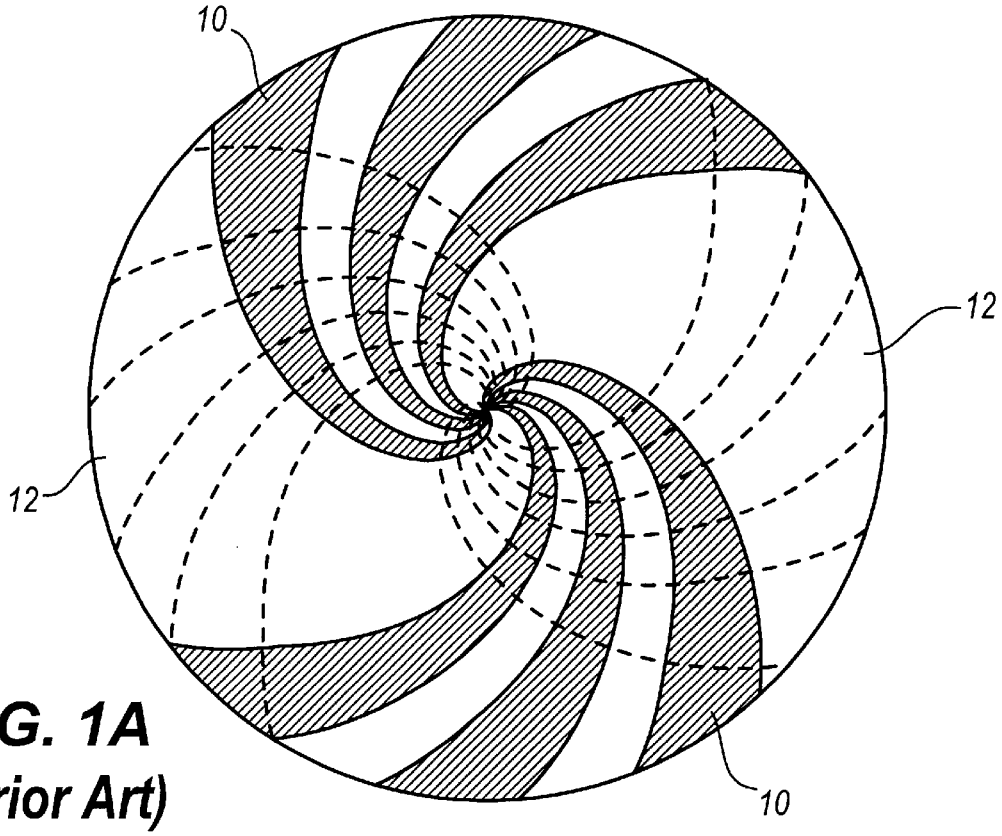
FIG. 1A (Prior Art)
FIG. 1A is a top view, partially in cross section, of a prior art circularly polarized antenna.
Figure 1B:
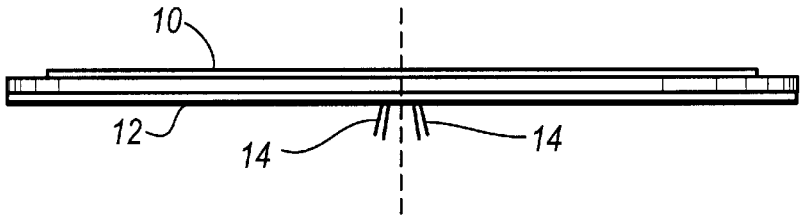
FIG. 1B (Prior Art)
FIG. 1B is a cross section view of a prior art circularly polarized antenna, showing a center feed point configuration for the elements within the antenna.
Figure 1C:
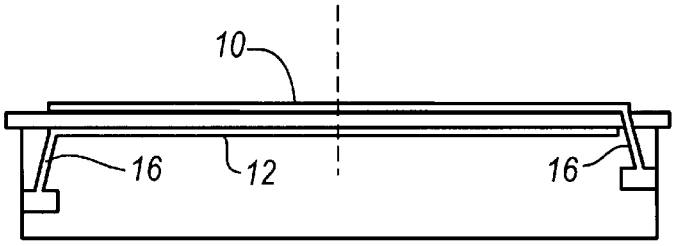
FIG. 1C (Prior Art)
FIG. 1C is a cross section view of a prior art circularly polarized antenna, showing an edge feed point configuration for the elements within the antenna.
Figure 2:
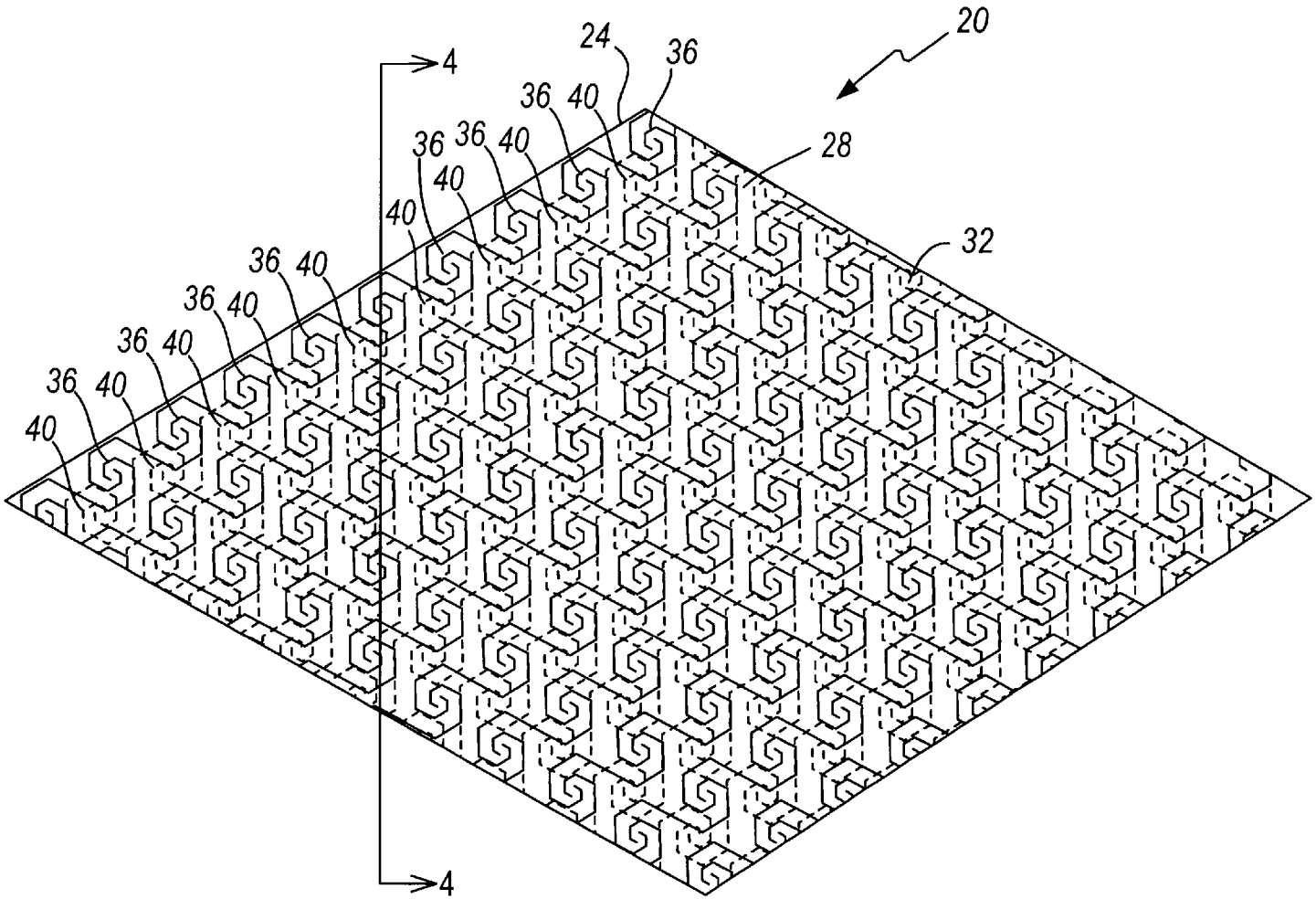
FIG. 2 is a top view, partially in cross section of the dual array antenna of the present invention.

A top view of an array antenna 20 of the present invention is shown in FIG. 2. A substrate member 24 supports a first array of antenna elements 28, shown with solid lines, and a second array of antenna elements 32, shown in dashed lines. The first array of antenna elements 28 contains spiral like antenna elements 36, and the second array of antenna elements 32 contains spiral like antenna elements 40.

Figure 3:
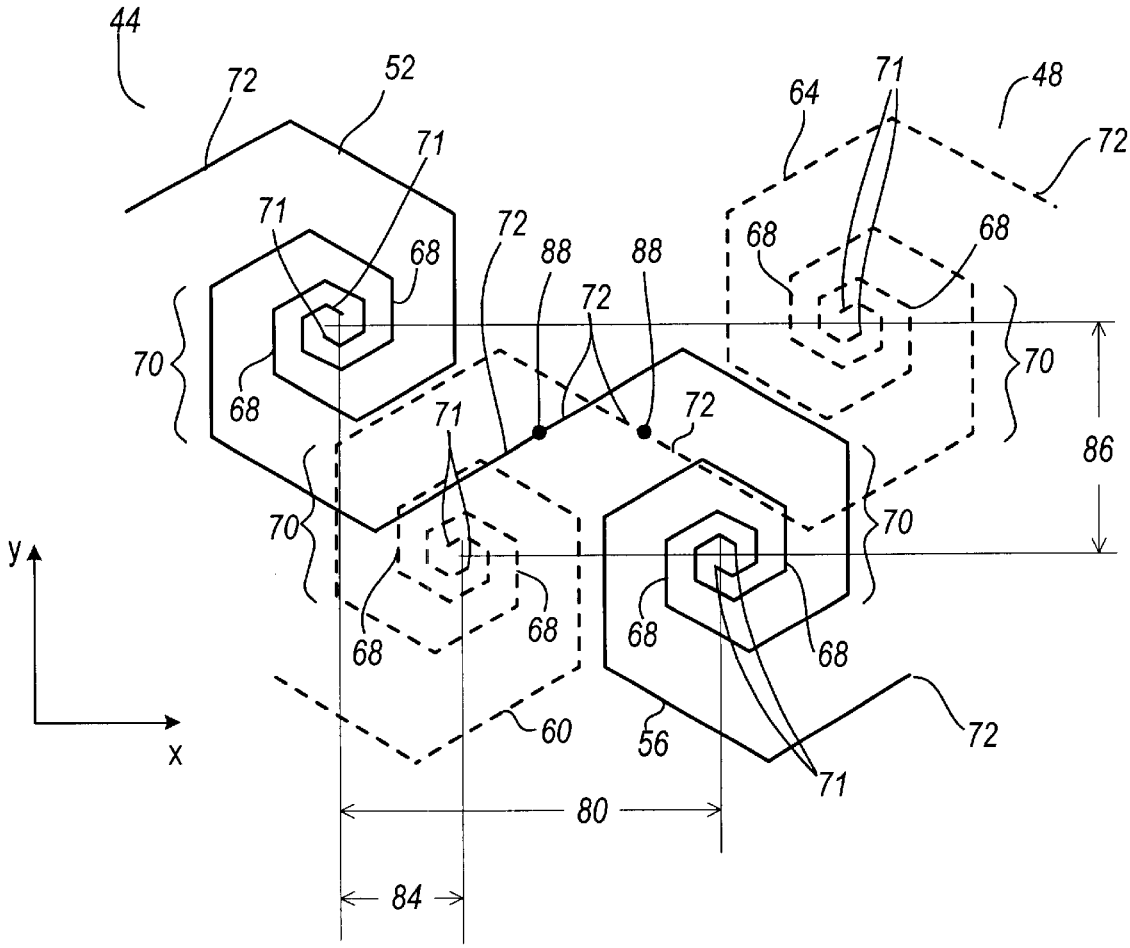
FIG. 3 is a top view, partially in cross section, of two top elements and two bottom elements of the dual array antenna.
Figure 4:
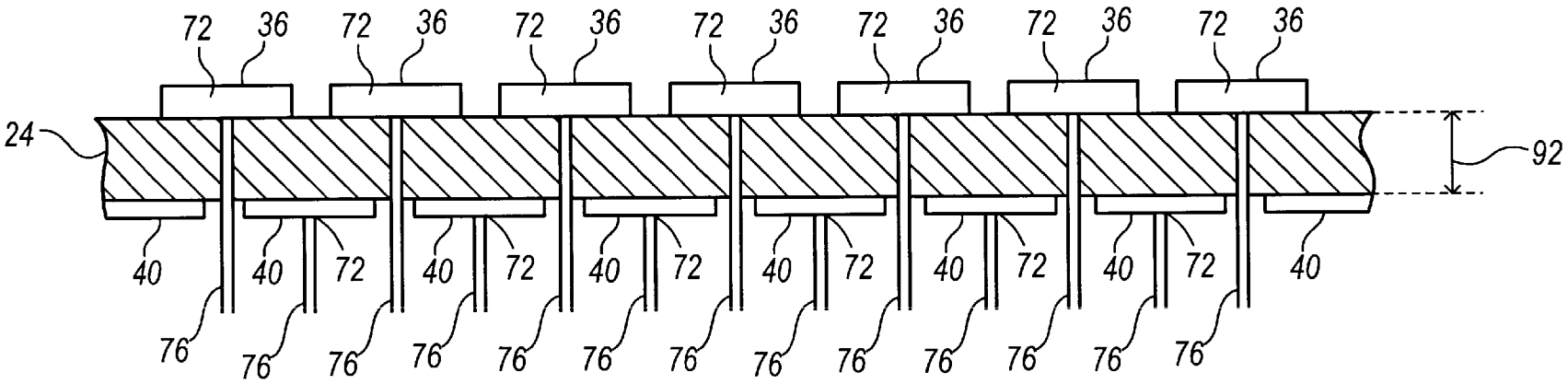
FIG. 4 is a cross section taken along the section 4—4 of FIG. 2.

With reference now to FIGS. 3 and 4, a partial view of the first and second arrays of antenna elements are shown in a top view and in a cross-section view along section 4—4 of antenna array 20. Here, a first pair 44 of two spiral like antenna elements from the first array of antenna elements 28 and a second pair 48 of two spiral like antenna elements from the second array of antenna elements 32 are shown. The first pair 44, shown in solid lines, contains a first element 52 and a second element 56, and the second pair 48, shown in dashed lines, contains a third element 60 and a fourth element 64. Each element contains two filars 68, which are configured in a spiral like configuration. Each filar 68 has a loop portion 70 having a free end 71, and a tail portion 72. The spiral-like elements of each array are center fed at a feed point 72 by a balun 76. In one embodiment, as shown in FIGS. 3 and 4, the filars 68 of the first element 52 and the second element 56 are oriented in a spiral-like configuration which rotates in a counterclockwise direction as they move away from the feed point 72. The filars 68 of the third element 60 and fourth element 64 are oriented in a spiral-like configuration which rotates in a clockwise direction as they move away from the feed point 72. Thus, the first array 28 in this example would transmit and receive right hand circularly polarized (RHCP) signals, and the second array 32 would transmit and receive left hand circularly polarized (LHCP) signals. As shown in FIG. 3, the first pair 44 of antenna elements lie in an X-Y plane, and the relative location of the second pair 48 of antenna elements can be referenced using this X-Y plane. The X-direction distance between the feed points 72 of the first element 54 and second element 56, is the lateral distance 80 separation. Each array is offset from the other in both the X direction and the Y direction such that their feed points 72 are not co-located, as shown in FIG. 3. The X-direction offset results in an X-direction offset between the feed point 72 of the first element 52 and the feed point 72 of the third element 60, this distance is the offset lateral distance 84. The Y-direction offset results in a Y-direction offset between the feed point 72 of the first element 52 and the feed point 72 of the third element 60, this distance is the axial distance 86. The offset between arrays results in a more simplified feed structure, as the balun 76 used to feed each element 36 in the first array 28 and the second array 32 have both an X and a Y distance between them, which simplifies the manufacture of the array.

The elements of each array are linked together to create one continuous linear chain of elements. In particular, all the RHCP and LHCP elements are joined at the tail ends 72 with neighboring elements at a connection point 88. As a result, the elements can be tightly packed within a lattice to support high frequency performance and still exhibit good low frequency performance. In some configurations, the connection point 88 may be resistively loaded to attain better performance.

Preferably, the elements are configured such that the tail ends 72 of adjacent elements meet at the connection point 88. In other configurations, however, the tail ends may not meet at the connection point 88. This may occur, for example, where the application for the antenna requires a specified frequency of operation. The frequency of operation is controlled by the element flare rate, that is how tightly the filars 68 spiral away from the feed point. In a situation that requires a flare rate which does not allow the tail ends 72 to meet at the connection point 88, the tail ends 72 may be connected with a connector. However, such a connector may degrade the right handed or left handed polarization of the signal that is being transmitted from the antenna.

The lattice geometry of the array determines the element shape. For example, a triangular lattice, as depicted in the figures, employs a hexagonal or 6-sided element, whereas a rectangular lattice (not shown) employs a rectangular or four sided element. Additionally, the lattice size determines how far off of boresight the antenna can scan without spawning grating lobes.

The offset lateral distance 84, the axial distance 86, plus the height distance 92, which is measured by the thickness of the substrate member 24 between the arrays, along with the element flare rate and orientation, can be adjusted to optimize antenna performance. For example, if an application required a certain element impedance for a specified frequency, one or more of these values may be adjusted to obtain the required antenna behavior. There are many considerations which may factor into antenna performance requirements, such as polarization requirements, frequency, gain, bandwidth and impedance.

Figure 5:
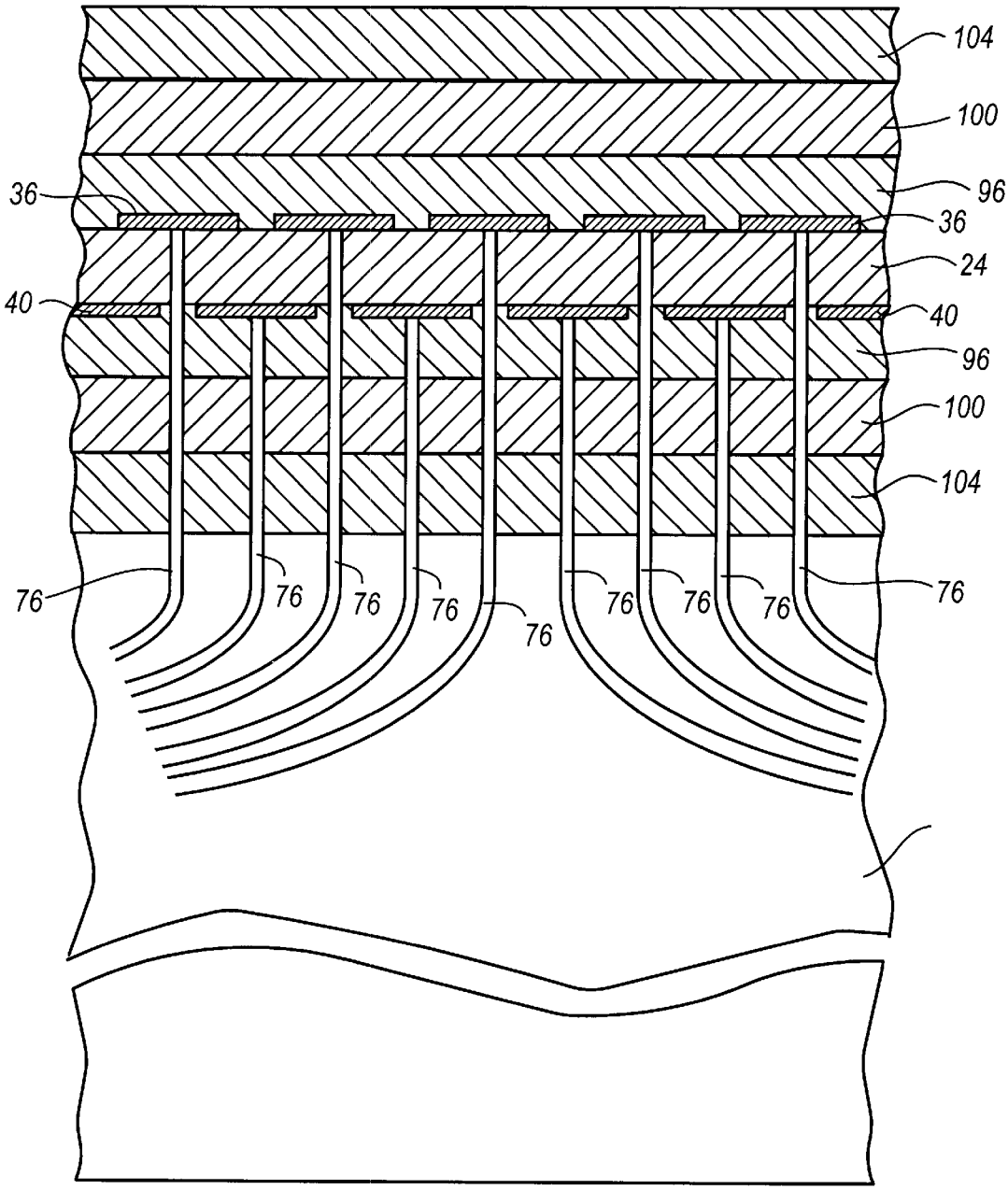
FIG. 5 is a cross section of the dual array antenna of one embodiment, showing tuning members and a cavity disposed adjacent to the substrate member.

Typically, the antenna elements reside on a low loss substrate material and may or may not be encapsulated within other materials. As shown in FIG. 5, in one embodiment, the substrate and arrays are encapsulated in a first tuning material 96, a second tuning material 100, and a third tuning material 104. These other materials may be chosen to improve antenna performance by fine tuning the antenna to specific requirements. For example, the tuning materials may improve the scan impedance of the elements, or provide a frequency shift, depending upon the application requirements for the antenna. Other circuits may also exist within the materials to improve scan impedance. The arrays are typically backed by a cavity 110 that can be either lossy or reactively loaded, again depending upon the requirements of the particular application the antenna is used in.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best modes presently known of practicing the inventions and to enable others skilled in the art to utilize the inventions in such, or in other embodiments, and with the various modifications required by their particular application or uses of the invention. It is intended that the appended claims be construed to include alternative embodiments to the extent permitted by the prior art.

What is claimed is:

1. A dual array antenna, comprising:

a first array comprising a first plurality of spiral-like antenna elements interconnected together on a first surface, said first plurality including at least first and second spiral-like antenna elements connected together, said first array transmitting and receiving right hand circularly polarized (RHCP) signals; and a second array comprising a second plurality of spiral-like antenna elements interconnected together on a second surface, said second plurality including third and fourth spiral-like antenna elements, with said first plurality not being interconnected with said second plurality, said second array transmitting and receiving left hand circularly polarized (LHCP) signals, at least said transmitted RHCP signals of said first array and at least said transmitted LHCP receive signals of said second array are transmitted with reduced coupling between said first and second arrays when said RHCP signals and said LHCP signals are transmitted simultaneously, wherein said first array does not essentially transmit LHCP signals when said second array transmits said LHCP signals and said second array does not essentially transmit said RHCP signals when said first array transmits RHCP signals, whereby isolation between said RHCP signals and said LHCP signals is enhanced;

wherein said first, second, third and fourth spiral-like antenna elements have first, second, third and fourth feed points, respectively, and said third and fourth feed points of said third and fourth spiral-like antenna elements are offset from said first and second feed points of said first and second spiral-like antenna elements.

2. The antenna, as claimed in claim 1, wherein:

said first surface and said second surface are part of the same substrate member.

3. The antenna, as claimed in claim 1, wherein:

said first and second feed points are separated by a lateral distance, said first and third feed points are separated by an offset lateral distance that is parallel to said lateral distance and an axial distance that is perpendicular to said lateral distance, said offset lateral distance is about one-half of said lateral distance.

4. The antenna, as claimed in claim 1, wherein:

said third and fourth feed points lie in a plane and said third feed point is offset laterally in at least a X-direction from said first feed point.

5. The antenna, as claimed in claim 4, wherein:

said third feed point is offset laterally in said X-direction and a Y-direction from said first feed point.

6. The antenna, as claimed in claim 1, wherein:

each of said first, second, third and fourth feed points is electrically connected to first, second, third and fourth baluns, respectively, each of said first, second, third and fourth baluns being non-co-planar relative to said first and second plurality of spiral-like antenna elements.

7. The antenna, as claimed in claim 2, further including:

a tuning member disposed outwardly of said substrate member.

8. The antenna, as claimed in claim 1, wherein:

said offset has a distance associated therewith and said distance is determined depending upon a plurality of factors including a plurality of the following: an impedance associated with the antenna, an operating frequency range associated with the antenna, a bandwidth associated with the antenna and a gain associated with the antenna.

9. The antenna, as claimed in claim 1, wherein:

each of said first and second spiral-like antenna elements includes a loop portion having a free end and a tail portion, said tail portions of said first and second spiral-like antenna elements being joined together.

10. The antenna, as claimed in claim 9, wherein:

said tail portions of said first and second spiral-like antenna elements being substantially straight adjacent where they are joined together.

11. An antenna, as claimed in claim 1, wherein:

said first and second spiral-like antenna elements are apart of a first number of spiral-like antenna elements that extend in a first direction and in which all of said spiral-like antenna elements of said first number are joined together and said first plurality of spiral-like antenna elements includes a second number of spiral-like antenna elements that extend in a second direction different from said first direction and in which said second number of spiral-like antenna elements are not connected together.

12. A method for providing a dual-array antenna, comprising:

forming a first spiral-like antenna element having a first feed point and a second spiral-like antenna element having a second feed point, said forming step including joining said first and second spiral-like antenna elements together, said first and second feed points being separated by a lateral distance, at least said first spiral-like antenna element and said second spiral-like antenna elements being part of a first array;

offsetting a third feed point of a third spiral-like antenna element from said first feed point, said offsetting step including offsetting laterally and offsetting axially said third feed point from said first feed point and in which an offset lateral distance is defined between said first and third feed points with said offset lateral distance being at least one-eighth of said lateral distance, at least said third spiral-like antenna element being part of a second array and said third spiral-like antenna element not being interconnected to said first and second spiral-like antenna elements;

transmitting right hand circularly polarized (RHCP) signals using said first array;

receiving RHCP signals using said first array;

transmitting left hand circularly polarized (LHCP) signals using said second array simultaneously with said transmitting of said RHCP signals;

receiving LHCP signals using said second array;

wherein at least said transmitted RHCP signals of said first array and said transmitted LHCP signals of said second array are transmitted with reduced coupling between said first and second arrays to enhance isolation between said RHCP signals and said LHCP signals.

13. The method, as claimed in claim 12, wherein:

each of said first and second spiral-like antenna elements includes a tail portion having an end and in which said joining step includes joining said ends of said tail portions together.

14. The method, as claimed in claim 12, wherein:

said offsetting step includes offsetting a fourth feed point of a fourth spiral-like antenna element from each of said first and second feed points and in which said fourth spiral-like antenna element is joined to said third spiral-like antenna element and said fourth spiral-like antenna element is part of said second array.

15. The method, as claimed in claim 12, wherein:

said third feed point lies in a plane having a X-direction and a Y-direction and in which said step of offsetting laterally includes offsetting laterally said third feed point from said first feed point in at least one of said X-direction and said Y-direction.

16. The method, as claimed in claim 12, wherein:

said forming step includes providing said first and second spiral-like antenna elements on a first surface of a substrate member and said offsetting step includes providing said third spiral-like antenna element on a second surface of said substrate member and with said step of offsetting axially including having said first and second surfaces substantially parallel to each other.

17. The method, as claimed in claim 12, wherein:

said offsetting step includes determining said offset lateral distance using a plurality of the following factors: an impedance associated with the antenna, an operating frequency range associated with the antenna, a gain associated with the antenna and a bandwidth associated with the antenna.

18. The method, as claimed in claim 12, further including:

disposing at least a first tuning member outwardly of said first, second and third spiral-like antenna elements and connecting each of said first, second and third feed points to separate electrical conductors.

* * * * *